United States Patent [19]

Hinzmann et al.

[11] Patent Number: 5,024,811

[45] Date of Patent: Jun. 18, 1991

[54] METHOD FOR MANUFACTURING DIMENSIONALLY CORRECT COMPACTS

[75] Inventors: Gerd Hinzmann, Brüggen; Norbert Nies, Neuss; Siegfried Radewahn, Mönchengladbach, all of Fed. Rep. of Germany

[73] Assignee: Mannesmann Aktiengesllschaft, Dusseldorf, Fed. Rep. of Germany

[21] Appl. No.: 539,065

[22] Filed: Jun. 15, 1990

[30] Foreign Application Priority Data

Jun. 15, 1989 [DE] Fed. Rep. of Germany ..... 3919847

[51] Int. Cl.[5] ..... B22F 7/00

[52] U.S. Cl. ..... 419/66; 264/109; 264/120; 264/500; 425/78

[58] Field of Search ..... 419/66; 264/500, 109, 264/120; 425/78

[56] References Cited

U.S. PATENT DOCUMENTS 3,698,843 10/1972 Bowles et al. ..... 425/86

4,472,350 9/1984 Urano ..... 419/6

*Primary Examiner*—Stephen J. Lechert, Jr.

*Attorney, Agent, or Firm*—Cohen, Pontani & Lieberman

[57] ABSTRACT

Precision compacts are produced from powdered material in a mold having at least one top plug and at least one bottom plug between which plugs the powdered material is compressed. The course of the pressing force of at least one of the plugs is detected as a function of the path of its travel during compression, and compared with a predetermined path-dependent tolerance range of the pressing force. Upon exceeding such tolerance range, the final pressing position of the plug in question is changed in such a manner that the height of the compact in such final pressing position is reduced by an amount corresponding to the increased springing back of the compact upon its removal from the mold that results from the greater final pressing force. In the absence of exceeding such tolerance range, the final pressing position of the plug in question is changed in such a manner that the weight of the compact in such final pression position is increased by an amount corresponding to the decreased springing back of the compact upon its removal from the mold that results from the lesser final pressing force.

5 Claims, 1 Drawing Sheet

METHOD FOR MANUFACTURING DIMENSIONALLY CORRECT COMPACTS

BACKGROUND OF THE INVENTION

The present invention relates to a method for producing dimensionally correct compacts of powdered material on a press in a mold having at least one top plug and at least one bottom plug between which plugs said powdered material is compressed. The present invention also relates to an apparatus for carrying out the foregoing method.

From Federal Republic of Germany 2,951,716 C2, a method is known for pressing moldings having at least one step of metal powder, by which moldings of constant height and density can be produced. For this purpose, the variation of the pressing force of the force plugs is measured as a function of the distance traveled, and is stored and compared with predetermined distance-dependent desired values. The precision in height of the compacts is in this connection assured by mechanical stops and by the stroke of the top force plug which can be set to a fixed value. The constant density is made possible within given limits of precision in the manner that the filling volume of the mold is reduced in the next operating cycle when the mentioned comparison of the pressing force has shown that the desired value has been exceeded. The reverse process is employed if the desired value has not been reached.

In this way, reaction changes in the properties of the metal powder used or other changes (for instance occurrence of given mechanical oscillations) which, in the final analysis, affect the bulk density of the powder and thus the compression properties of the powder introduced into the mold, can be reacted to. To be sure, in this case, the correction can act only in connection with the next compact since no change in the filling volume of the mold is possible any longer in the case of the compact on which the differences from the desired value were noted. The known method, however, results in definite improvements over the prior art which was known up to that time with respect to the simultaneous maintaining of density and precision of shape of the compacts. In the event of particularly high demands on the precision of the compacts, however, this method is not always sufficient and it may lead to considerable rejects due to the unavoidable dead time of the method of regulation used.

SUMMARY OF THE INVENTION

An object of the present invention is therefore to provide a method and apparatus which permit even closer tolerances with respect to the precision in shape of the compacts and at the same time further reduces the danger of the production of rejects.

The foregoing object is achieved in a method of producing precision compacts from powdered material in a mold having at least one top plug and at least one bottom plug, between which said powdered material is compressed. In the method, the course of the pressing force of at least one of the plugs is detected as a function of the path of its travel during compression. Such course of pressing force is compared with a predetermined path-dependent tolerance range of the pressing force. Upon exceeding such tolerance range, the final pressing position of the plug in question is changed in such a manner that the height of the compact in such final pressing position is reduced by an amount corresponding to the increased springing back of the compact upon its removal from the mold that results from the greater final pressing force. In the absence of exceeding such tolerance range, the final pressing position of the plug in question is changed in such a manner that the height of the compact in such final pressing position is increased by an amount corresponding to the decreased springing back of the compact upon its removal from the mold that results from the lesser final pressing force.

A basis of the invention is the discovery that the precision of a compact produced from powdered material does not depend only on the top and bottom plugs, which produce the shape, being brought into a position in which their pressing surfaces have relative distances from each other corresponding to those of the compact to be produced.

Every compact is to a certain extent elastic and therefore springs back after removal from the mold. The amount of this springing back is dependent on the density of the compact and thus, indirectly, on the pressing force applied. In principle, the springing back will be greater, the greater the pressing force. The relationship between density and pressing force, however, is nonlinear and is dependent on the powdered material used. If the force plugs are brought precisely into the same position with respect to each other upon the manufacture of compacts of the same shape, there is still, therefore, a lack of assurance that two compacts of exactly the same size will also result. If a greater pressing force is applied on one, as a result of the greater bulk density of the powder filling, then, in the case of the other, parts which differ will be obtained in all cases since the amount of springing back upon removal of the compact from the mold will necessarily differ.

The recognition of this fact has been utilized for the invention in that the springing back of the molding upon the final determination of the end position of the force plugs is taken into consideration in the end position of the pressing. For this purpose, the pressing force used must be measured on the plug in question, and a spring path be determined which corresponds to the spring characteristic of the compact at this place (for instance at each vertical step in the case of a stepped compact). The greater the springing back to be expected, the closer the pressing surfaces of the facing plugs must be brought to each other. In accordance with the invention, the course of the pressing force is determined as a function of the path of movement of at least one, and in the extreme case each plug which is to produce a dimensionally precise part of the compact, and such course of pressing is then compared with a path-dependent tolerance range. As soon as the pressing force leaves the tolerance range, a corresponding correction of the originally specified desired position of the plug in question is determined. This correction is preferably carried out during the compacting of the compact in connection with which the deviation has been found.

Since the reasons for the modified pressing behavior of the pile of powder present in the press mold generally do not change suddenly, it may frequently also be sufficient for the correction value ascertained to be taken into account only in the case of the next molding to be pressed.

As a further development of the invention, a second path-dependent tolerance range of the pressing force can be provided for the force plug upon the leaving of which tolerance range a corresponding compensation change in the filling volume of the press mold is brought about by the control in the next operating cycle. This second tolerance range is, in all cases, wider than the first and covers it completely. In this way, even greater changes in the bulk density of the powder filling can be compensated for in their effects on the geometry of the compact.

Finally, an even wider path-dependent tolerance range of the pressing force can be provided, upon departure from which the press is disconnected. Upon an exceeding of the maximum permissible pressing force, a cold welding of plugs may, for instance, have been the cause so that a major damage to the mold is avoided by stopping the press. Conversely, if the minimum pressing force is not reached, the press mold may not have been filled sufficiently if at all, due to a disturbance, for instance, in the supply of powder, so that, also in such a case, the press must be disconnected in order to avoid damage to the mold.

BRIEF DESCRIPTION OF THE DRAWING FIGURES

The invention will be explained in further detail below with reference to an exemplary embodiment shown in the accompanying drawing figures, in which FIGS. 1 to 3 illustrate successive states in a molding operation of powdered material contained between upper and lower plugs in a mold in accordance with the invention.

DETAILED DESCRIPTION OF THE PREFERRED EMBODIMENTS

Figures 1, 2, 3:
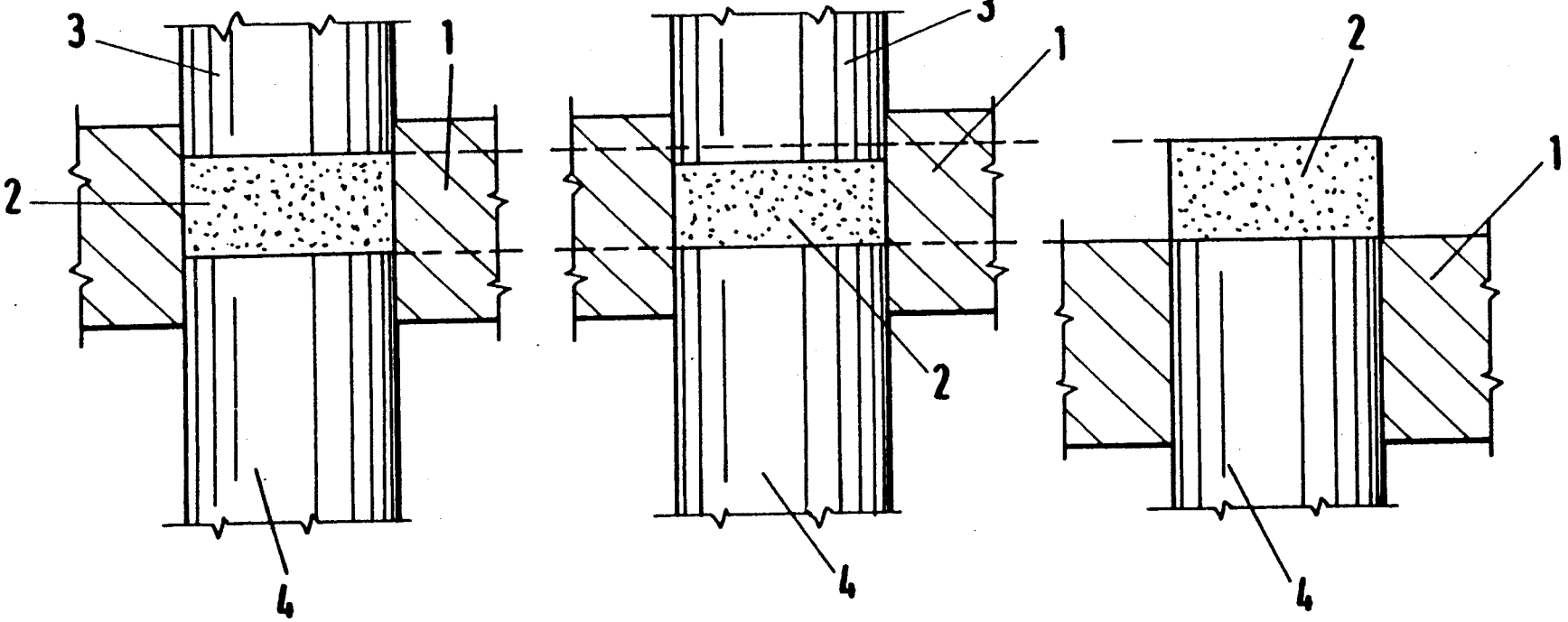

The iron powder 2 which is introduced into a mold cavity 1 is compacted to such a extent by a top plug 3 and a bottom plug 4 that the distance between top plug 3 and bottom plug 4 corresponds to the height of the molding 2 which is to be produced. This condition is shown in FIG. 1. As a function of the resultant density of the iron powder, there results a pressing force with which there can be associated a given springing back of the molding 2 which takes place when the molding 2 is released from the mold. The course of the curve of the pressing force as a function of the springing back is determined in prior tests for the iron powder used. As a rule, this curve can be linearized with sufficient approximation in the section relevant for the tolerance range. As shown in FIG. 2, the plugs 3 and 4 are moved further towards each other by the amount of this springing back. Upon this procedure, after the release of the molding 2, precisely that height of the molding 2 which was desired will result due to the springing back which takes place (FIG. 3).

It should be understood that the preferred embodiments and examples described are for illustrative purposes only and are not to be construed as limiting the scope of the present invention which is properly delineated only in the appended claims.

What is claimed is:

1. A method of producing precision compacts from powdered material in a mold having at least one top plug and at least one bottom plug between which plugs said powdered material is compressed, the method comprising the steps of:

detecting the course of the pressing force of at least one of the plugs as a function of the path of its travel during compression;

comparing said course of pressing force with a predetermined path-dependent tolerance range of the pressing force;

upon exceeding said tolerance range, changing the final pressing position of the plug in question in such a manner that the height of the compact in such final pressing position is reduced by an amount corresponding to the increased springing back of the compact upon its removal from the mold that results from the greater final pressing force; and in the absence of exceeding said tolerance range, changing the final pressing position of the plug in question in such a manner that the height of the compact in such final pressing position is increased by an amount corresponding to the decreased springing back of the compact upon its removal from the mold that results from the lesser final pressing force.

2. The method according to claim 1, wherein the change in the final position of the press plug in question is affected during the operating cycle in which the deviation of the pressing force from the tolerance range has been established.

3. The method according to claim 1, further comprising the steps of:

predetermining a second path-dependent tolerance range of the pressing force that completely encompasses the first tolerance range;

upon exceeding said second tolerance range, reducing the filling volume of the mold for a subsequent operating cycle; and in the absence of exceeding said second tolerance range, increasing the filling volume of the mold for a subsequent operating cycle.

4. A method according to claim 3, further comprising the steps of:

predetermining a third path-dependent tolerance range of the pressing force that completely encompasses at least the first tolerance range; and automatically disconnecting the press when the actual pressing force lies outside the third tolerance range.

5. The method according to claim 1, wherein said powdered material comprises metal powder.

* * * * *

UNITED STATES PATENT AND TRADEMARK OFFICE

CERTIFICATE OF CORRECTION

PATENT NO. : 5,024,811

DATED : June 18, 1991

INVENTOR(S) : Gerd Hinzmann, Norbert Nies, Siegfried Radewahn

It is certified that error appears in the above-identified patent and that said Letters Patent is hereby corrected as shown below:

On the title page item [73] Assignee;

should read as follows; Mannesmann Aktiengesellschaft.

Signed and Sealed this

First Day of December, 1992

*Attest:*

DOUGLAS B. COMER

*Attesting Officer*

*Acting Commissioner of Patents and Trademarks*